US005989771A

United States Patent [19]

Ohta et al.

[11] Patent Number: 5,989,771

[45] Date of Patent: Nov. 23, 1999

[54] INK JET RECORDING MATERIALS

[75] Inventors: Tetsuzi Ohta, Mitaka; Takayuki Aikawa, Hannou; Masayuki Yamaguchi, Kasukabe, all of Japan

[73] Assignee: Kimoto Co., Ltd., Japan

[21] Appl. No.: 09/021,376

[22] Filed: Feb. 10, 1998

Related U.S. Application Data

[62] Division of application No. 08/670,821, Jun. 25, 1996, abandoned.

[30] Foreign Application Priority Data

Jun. 27, 1995 [JP] Japan ..... 7-183473
Jun. 27, 1995 [JP] Japan ..... 7-183474

[51] Int. Cl.[6] ..... B41M 5/00

[52] U.S. Cl. ..... 430/200; 347/105; 428/195

[58] Field of Search ..... 347/105; 428/195; 430/200

[56] References Cited

U.S. PATENT DOCUMENTS

| | | | |
|---|---|---|---|
| 3,778,272 | 12/1973 | Hepher | 96/87 |
| 3,899,332 | 8/1975 | Traskos | 96/33 |
| 4,555,427 | 11/1985 | Kawasaki et al. | 428/195 |
| 5,409,504 | 4/1995 | Fritzsche | 8/444 |
| 5,496,634 | 3/1996 | Ogawa et al. | 428/341 |
| 5,569,573 | 10/1996 | Takahashi et al. | 430/138 |

FOREIGN PATENT DOCUMENTS

| | | |
|---|---|---|
| 59-190885 | 4/1983 | Japan . |
| 61-188181 | 2/1985 | Japan . |
| 63-183873 | 1/1987 | Japan . |
| 3-281384 | 3/1990 | Japan . |

*Primary Examiner*—Bruce H. Hess

[57] ABSTRACT

Provided is an ink jet recording material comprising a substrate and an ink-receiving layer provided on at least one surface of the substrate, wherein the ink-receiving layer comprises a water-soluble photosensitive resin. The ink jet recording material shows excellent water resistance without sacrificing ink-receiving properties and requiring no or only a simple post-treatment.

6 Claims, No Drawings

INK JET RECORDING MATERIALS

CROSS-REFERENCE TO RELATED APPLICATION

This application is a division of application Ser. No. 08/670,821 filed Jun. 25, 1996 and entitled "Ink Jet Recording Materials," now abandoned.

BACKGROUND OF THE INVENTION

The present invention relates to ink jet recording materials (recording materials for ink jet printing).

The ink jet recording method performs recording by causing ink (recording liquid) droplets generated and scattered by various ink-ejecting principles to be at least partially absorbed on a recording material such as a paper sheet. Ink jet recording enables high quality printing or multi-color printing with such advantages as low operating noise and high speed.

Recording inks used for ink jet recording are generally aqueous inks mainly composed of water in view of safety and recording properties. In addition, such recording inks are often added with an agent such as polyhydric alcohols in order to prevent clogging of ink paths and ink nozzles of ink jet printers and to improve the ink ejection stability.

Under these circumstances, most recording materials used for ink jet recording have an ink-receiving layer comprising a water-soluble resin (see, for example, Japanese Patent Application Un-examined Publication Nos. 61-188181 and 3-281384).

On the other hand, recent technical developments have led to wide use of multi-color printing by the ink jet recording technique for the printing of display and presentation materials such as posters and sign boards. When such printed materials are used as open air displays, the ink-receiving layer is particularly required to have water-resistance to an extent that it is not damaged by wind and rain, humidity, or wet or sweaty hands.

However, because most conventional ink jet recording materials comprise a water-soluble resin in their ink-receiving layers as described above, they exhibit poor water resistance.

Therefore, various attempts have been made to improve the water resistance.

For example, Japanese Patent Application Un-examined Publication No. 63-183873 discloses a method for providing an ink-receiving layer comprising a denatured polyvinyl alcohol and a water resistant agent. However, this method has the drawback that ink absorption deteriorates as water resistance improves.

Further, Japanese Patent Application Un-examined Publication No. 59-190885 discloses a recording material whose ink-receiving layer is applied or impregnated with a photocurable resin after the ink jet printing. However, this material requires troublesome post-treatments, i.e., application or impregnation and curing of the resin.

The present invention has been achieved to solve the problems mentioned above and its object therefore is to provide an ink jet recording material showing excellent water resistance without sacrificing ink-receiving properties and requiring no or only a simple post-treatment.

DESCRIPTION OF THE INVENTION

The present invention provides an ink jet recording material comprising a substrate and an ink-receiving layer provided on at least one surface of the substrate, wherein the ink-receiving layer comprises a water-soluble photosensitive resin. The water-soluble photosensitive resin of the ink-receiving layer may be cured before or after the ink jet printing operation.

The substrate used for the recording material of the present invention may be, for example, a plastic sheet made of a polyester, polycarbonate, acetyl-cellulose, polyimide, polyethylene, polystyrene, polypropyrene, polyvinyl chloride, polyvinyl alcohol and the like, a paper sheet of machine-made or Japanese paper, or cloth. When the recording material is required to transmit light, a transparent plastic film is preferably used as the substrate. The thickness of the substrate may be optionally selected for the intended use and generally ranges from 5 to 500 $\mu$m.

The ink-receiving layer provided on at least one surface of the substrate comprises a water-soluble photosensitive resin in order to improve water resistance without reducing ink absorption.

The water-soluble photosensitive resin used for the ink jet recording material of the present invention is a resin which undergoes curing reaction upon exposure to an active radiation such as visible rays and ultraviolet rays and is water-soluble before curing and substantially insoluble in water after curing. However, the water-soluble photosensitive resin used in the present invention exhibits hydrophilicity even after curing and maintains sufficient ink-receiving properties including ink absorbing property and ink retention property. As such water-soluble photosensitive resin, there can be mentioned those of photocrosslinkable type, photolysis type, photodepolymerizable type, photomodifiable type, photopolymerizable type and the like.

Those water-soluble photosensitive resins are well known in the art and a variety of such resins are commercially available. Any of such commercially available water-soluble photosensitive resins may be suitably used in the present invention.

Among these water-soluble photosensitive resins, those of photocrosslinkable type are the most preferred, since they show satisfactory curing without suffering from oxygen inhibition, which is specific to those undergoing radical polymerization, or other problems relating to curing.

As the photosensitive resins of the photocrosslinkable type, those of the photodimerizable type and the diazo type are preferred because of the ease of their handling. Further, among the photodimerizable resins, those incorporated with cinnamoyl groups, stilbazolium groups and styrylquinolium groups are particularly preferred in terms of water resistance and ink absorption.

When these photosensitive groups are not incorporated into the resin itself and the crosslinking is effected in such a manner as in diazo resins, coatings of cured resin composed solely of photosensitive resin are likely to become brittle. Therefore, a hydrophilic resin which can be cured by reaction with functional groups is, as required, preferably added to such photosensitive resins as mentioned above.

Examples of such a hydrophilic resin include, for example, starch, gelatin, casein, gum arabic, sodium alginates, methylcelluloses, hydroxyethylcelluloses, carboxymethylcelluloses, polyvinylpyrrolidones, polyvinyl alcohols, polyurethanes, polyethylene glycols, polyethylene oxides, poly(meth)acrylates, water-soluble polyesters, polyacrylamides, copolymers derived from those monomers constituting the aforementioned polymers, modified versions of these polymers and any mixture thereof.

The hydrophilic resin may also be added to those photosensitive resins wherein photosensitive groups are incorporated into the resins so long as the hydrophilic resin does not adversely affect the properties of the ink-receiving layer required for the purpose of the present invention.

The ink-receiving layer may further contain, in addition to the photosensitive resin mentioned above, anti-blocking agents, pigments for improving writing property and imparting light hiding property, anti-oxidants, UV absorbers, surfactants, pH modifiers and the like.

Examples of the pigments include, for example, inorganic pigments such as silica, clay, smectite, mica, talc, titanium oxide, zinc oxide, calcium carbonate, barium sulfate and aluminum oxide, and organic pigments such as those composed of acrylic resins, silicone resins, celluloses and polystyrenes.

The ink-receiving layer has a thickness of at least 1 μm, preferably 2 μm, and at most of 50 μm, preferably 20 ρm. The ink-receiving layer should have a thickness of at least 1 μm because an ink-receiving layer having a thickness of less than 1 μm cannot provide sufficient ink absorption, and it should have a thickness of not more than 50 μm in order to obtain good active ray energy utilization efficiency upon light exposure.

The ink jet recording material of the present invention can be produced by applying a coating solution for the ink-receiving layer comprising the photosensitive resin and other additives, if necessary, dissolved or dispersed in a solvent such as water, alcohols, ketones and cellosolves through a conventional coating method such as roll coating, bar coating, air knife coating and spray coating on a substrate composed of, for example, a plastic film, and drying the coated layer.

The ink-receiving layer may be provided on one or both surfaces of the substrate. When the ink-receiving layer is provided on one surface of the substrate, a back coat layer is preferably provided on the opposite surface in order to prevent curling of the material, to improve slipping or transportation property and the like.

The ink-receiving layer of the ink jet recording material according to the present invention may be cured before or after ink jet printing. That is, the ink jet recording material of the present invention includes both those having an ink-receiving layer comprising an uncured photosensitive resin and those having an ink-receiving layer comprising a cured photosensitive resin.

Because of the incorporation of the photosensitive resin into the ink-receiving layer, the ink-receiving layer shows good ink-receiving properties even if the photosensitive resin has been cured before printing. However, if the photosensitive resin is not cured, the recording properties, including the ink-receiving properties of the material, are not degraded by curing of the photosensitive resin, whereby further improved ink receiving properties can be obtained.

The ink-receiving layer of the ink jet recording material according to the present invention obtained as above can be cured, either before or after printing, by irradiating it with light energy in the required amount, i.e., exposing the layer to an active ray capable of producing the curing reaction of the photosensitive resin, such as ultraviolet rays, visible light rays, infrared rays, far infrared rays, alpha rays, beta rays, gamma rays and X-rays. By curing the ink-receiving layer as described above, a recording material with excellent water resistance can be obtained before or after printing.

The printing using the recording material of the present invention can be performed, either before or after the curing of the ink-receiving layer, by any conventional ink jet printing apparatuses or by other writing tools such as pen plotters and pens.

The ink jet printing material of the present invention exhibits excellent water resistance. However, the ink itself often shows poor light resistance and recorded images may fade with time, particularly when the printed matter is used in the open air. To solve this problem, a UV absorber may be added to the substrate or the back coat layer.

Especially when the ink-receiving layer is provided on only one surface of the substrate, it is advantageous to print the images as mirror images (reverse images) to be observed through the substrate and, optionally, the back coat layer, so that the added UV absorber compensates for the poor light resistance of the printing ink. Thus, the recording material of the present invention having such a construction as mentioned above is useful when the printed materials are used in the open air.

If a UV absorber is added to the substrate or the back coat layer and the ink jet recording materials are stored in a stack with the ink-receiving layers comprising the photosensitive resin facing away from the light source (generally downward), the substrate or the back coat layer serves as a protective layer for the ink-receiving layer and can prevent occurrence of curing reaction of the photosensitive resin before light exposure. When the recording material is stored in the form of rolled sheet, the material is preferably rolled with the ink-receiving layer facing inward so as to prevent curing of the photosensitive resin and consequent degradation of the recording properties.

Because the ink-receiving layer of the present ink jet recording material comprises a water-soluble photosensitive resin and is cured before or after the printing, improved water resistance can be obtained without sacrificing ink absorption.

EXAMPLES

The present invention will be further explained more in detail with reference to the following non-limitative examples.

Example 1

A coating solution for ink-receiving layer was prepared by dissolving 20 parts by weight of polyvinyl alcohol (GOHSENOL NH-05, Nippon Synthetic Chemical Industry Co., Ltd.) and 1 part by weight of a diazo resin (PHOTOSPIRIT B, Tokyo Ohka Kogyo Co., Ltd.) in 199 parts by weight of water. This coating solution was applied to one surface of a substrate composed of a polyester film (LUMIRROR Q81, Toray Industries, Inc.; thickness: 100 μm) by a bar coater so that the coated layer would have a dry thickness of 5 μm, and the coated layer was dried with a drier for 3 minutes at 100° C to obtain an ink jet recording material having an uncured ink-receiving layer.

Example 2

An ink jet recording material was prepared in a manner similar to that of Example 1 except that the coating solution consisted of 2 parts by weight of polyvinyl alcohol (GOHSENOL NH-05, Nippon Synthetic Chemical Industry Co., Ltd.) and 8 parts by weight of polyvinyl alcohol bearing stilbazolium groups (SSP-H13, Toyo Gosei Kogyo Co., Ltd.) dissolved in 115 parts by weight of water.

Example 3

An ink jet recording material was prepared in a manner similar to that of Example 2 except that the ink-receiving layer had a dry thickness of 50 μm.

Comparative Example 1

An ink jet recording material was prepared in a manner similar to that of Example 1 except that the coating solution consisted of 10 parts by weight of polyvinyl alcohol (GOHSENOL NH-05, Nippon Synthetic Chemical Industry Co., Ltd.) dissolved in 115 parts by weight of water.

Comparative Example 2

An ink jet recording material was prepared in a manner similar to that of Example 2 except that the ink-receiving layer had a dry thickness of 0.5 $\mu$m.

Examples 4 to 6 and Comparative Examples 3 and 4

Ink jet recording materials were prepared as in Examples 1 to 3 and Comparative Examples 1 and 2 (Examples 4 to 6 and Comparative Examples 3 and 4) and each of the obtained recording materials except for that of Comparative Example 3 was subjected to light exposure with a high pressure mercury lamp at 300 mJ/cm$^2$ to obtain ink jet recording materials whose ink-receiving layers had been cured.

The ink jet recording materials obtained in Examples 1 to 6 and Comparative Examples 1 to 4 were printed using an ink jet printer (BJC600J, Canon Inc.). The ink jet recording materials of Examples 1 to 3 and Comparative Example 2 were exposed to light from a high pressure mercury lamp at 300 mJ/cm$^2$ after printing. The ink drying property, blur property, water resistance and ink retention property of the obtained printed materials were evaluated. The results are shown in Table 1.

TABLE 1

| | Drying property | Blur property | Water resistance | Ink retention |
|---|---|---|---|---|
| Example 1 | E | E | E | E |
| Example 2 | E | E | E | E |
| Example 3 | E | E | E | E |
| Example 4 | G | G | E | G |
| Example 5 | G | G | E | G |
| Example 6 | G | G | E | G |
| Comparative Example 1 | G | G | P | No evaluation |
| Comparative Example 2 | P | P | E | F |
| Comparative Example 3 | G | G | P | No evaluation |
| Comparative Example 4 | P | P | E | F |

Ink drying property: The whole surface of the recording material was printed solid and the printed portion was rubbed with a finger 10 minutes after the printing. When no or substantially no ink transfer was observed, the ink drying property was evaluated as "Excellent (E)" or "Good (G)", respectively. When the printed area had not dried, it was evaluated as "Poor (P)".

Blur property: Fine lines were printed over the whole surface of the recording material and the printed lines were visually evaluated with the naked eye. When no or substantially no blur was observed, the blur property was evaluated as "Excellent (E)" or "Good (G)", respectively. When blur was observed, it was evaluated as "Poor (P)".

Water resistance: The recording material was immersed into water and its ink-receiving layer was rubbed. When no or substantially no dissolving or peeling of the ink-receiving layer occurred, the water-resistance was evaluated as "Excellent (E)" or "Good (G)", respectively. When the ink-receiving layer dissolved or peeled, it was evaluated as "Poor (P)".

Ink retention property: After printing of the recording material in a printer, the whole printed surface was immersed in water at 20° C, left to stand for 2 hours, and the printed image was thereafter visually evaluated with the naked eye. When no or substantially no change of the images was observed, the ink retention was evaluated "Excellent (E)" or "Good (G)", respectively. When the image faded fairly but was nevertheless distinguishable, it was evaluated as "Fair (F)". When the image was not distinguishable, it was evaluated as "Poor (P)". "No evaluation" means that the evaluation was impossible because of poor water resistance.

Examples 7 and 8

A coating solution consisting of 40 parts by weight of polyester resin (VYLON 200, Toyobo Co., Ltd.), 8 parts by weight of a UV absorber (UVINAL, ISP Co., Ltd.) dissolved in 70 parts by weight of methyl ethyl ketone, 70 parts by weight of toluene and 20 parts by weight of cyclohexanone was applied with a bar coater to the surface of the ink jet recording materials of Examples 3 and 6 opposite to the one provided with the ink-receiving layer so that the coated layer would have a dry thickness of 3 $\mu$m to produce ink jet recording materials having an ultraviolet ray shielding layer.

Printing was performed as in Examples 1 to 6 and, in Example 7, light exposure was effected as in Examples 1 to 3 to cure the ink-receiving layer.

The light resistance of the ink jet recording materials of Examples 7 and 8 was evaluated with a fade meter (FAL-3, Suga Test Instruments Co., Ltd.) . While 10% of the initial optical density of the images formed on the material without the ultraviolet ray shielding layer (Examples 3 and 6) faded within 3 hours, less than 5% of the initial optical density of the images formed on the material with the ultraviolet ray shielding layer (Examples 7 and 8 ) faded even after 24 hours.

As shown in Table 1, the recording materials of Examples 1 to 6 showed generally excellent results including printing properties and water resistance. The recording materials of Examples 3 and 6 having a thick ink-receiving layer (thickness: 50 $\mu$M) showed particularly high ink absorbing rate.

Further, the recording materials of Examples 7 and 8 showed less fading of printed images after irradiation of UV ray because they had a back coat layer containing a UV absorber.

On the other hand, the recording materials of Comparative Examples 1 and 3 having an ink-receiving layer composed solely of a water-soluble resin showed substantially no water resistance, while they showed good printing properties.

Further, when the thickness of the ink-receiving layer was too thin as in Comparative Examples 2 and 4, the ink absorption was poor and the materials show bad drying property and blur property despite the fact that the same material as in Example 2 was used.

Because the ink jet recording materials of the present invention comprise a water-soluble photosensitive resin in the ink-receiving layer, they show improved water resistance without degrading ink absorption. In particular, the recording properties of the recording materials of the present invention where the ink-receiving layer is cured after printing are not adversely affected by curing of the photosensitive material. In addition, since sufficient water resistance can be obtained by curing the photosensitive resin, the ink jet recording materials of the present invention are particularly advantageous when the printed recording materials are used in the open air.

CROSS-REFERENCE TO RELATED APPLICATION

This application is a division of application Ser. No. 08/670,821 filed Jun. 25, 1996 and entitled "Ink Jet Recording Materials" , now abandoned.

What is claimed is:

1. An ink-jet printing process comprising:

providing an ink-jet recording element comprising a substrate and an ink-receiving layer containing a water-soluble uncured photosensitive resin;

printing an image on said uncured photosensitive resin layer utilizing an ink-jet; and curing said photosensitive resin layer with said image printed thereon.

2. The method of claim 1, wherein said resin contains a group selected from cinnamoyl, stylbazolium, styrylquinolium and diazo.

3. The method of claim 1, wherein said ink-receiving layer has a thickness of 1 to 50 $\mu$m.

4. The method of claim 1, wherein the ink-receiving layer has a thickness of 2 to 20 $\mu$m.

5. The method of claim 1, wherein an ultraviolet ray absorbing layer or an ultraviolet ray shielding layer is provided on one surface of the substrate opposite to the one provided with the ink-receiving layer.

6. The method of claim 1, wherein said substrate absorbs or shields ultraviolet rays.

* * * * *